US006434477B1

(12) United States Patent
Goss et al.

(10) Patent No.: US 6,434,477 B1
(45) Date of Patent: Aug. 13, 2002

(54) METHOD FOR REQUESTING AND PROCESSING TRAFFIC INFORMATION

(75) Inventors: Stefan Goss; Jan Martin, both of Hildesheim; Heinz Werner Pfeifffer, Hohenhameln; Hans-Dieter Schmidt, Hildesheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/568,839

(22) Filed: May 11, 2000

(30) Foreign Application Priority Data

Aug. 12, 1999 (DE) ..... 199 37 372

(51) Int. Cl.[7] ..... G08G 1/09; G08G 1/0967; H04H 1/00

(52) U.S. Cl. ..... 701/117

(58) Field of Search ..... 701/117, 200, 701/201, 209, 210, 211; 342/357.09, 357.1; 340/992, 989

(56) References Cited

U.S. PATENT DOCUMENTS

| | | | | |
|---|---|---|---|---|
| 5,131,020 A | | 7/1992 | Liebesny et al. | |
| 5,345,606 A | * | 9/1994 | Duckeck et al. | 455/186.1 |
| 5,406,490 A | * | 4/1995 | Braegas | 364/449 |
| 5,543,789 A | | 8/1996 | Behr et al. | |
| 5,818,356 A | * | 10/1998 | Schuessler | 340/995 |
| 5,835,854 A | * | 11/1998 | Palisson et al. | 455/186.1 |
| 5,864,305 A | * | 1/1999 | Rosenquist | 340/905 |
| 5,987,382 A | * | 11/1999 | Weishaupt et al. | 701/211 |
| 6,018,649 A | * | 1/2000 | Ruhl | 455/186.1 |
| 6,111,521 A | * | 8/2000 | Mulder et al. | 340/905 |
| 6,178,378 B1 | * | 1/2001 | Leibold | 701/202 |
| 6,226,646 B1 | * | 5/2001 | Geurts | 707/100 |

FOREIGN PATENT DOCUMENTS

| | | |
|---|---|---|
| DE | 35 36 820 | 4/1987 |
| DE | 196 51 143 | 6/1998 |
| DE | 197 08 748 | 9/1998 |
| DE | 197 39 257 | 3/1999 |
| WO | WO 98/26396 | 6/1998 |
| WO | WO 99/34343 | 7/1999 |

OTHER PUBLICATIONS

Standard ENV–278/7/3/0006; Jul. 1997.

* cited by examiner

*Primary Examiner*—Michael J. Zanelli
(74) *Attorney, Agent, or Firm*—Kenyon & Kenyon

(57) ABSTRACT

A method for requesting and for processing traffic information, in which a traffic-information query is transmitted by a mobile transceiver, and at least one traffic message is provided by a service provider via a base station, the traffic message being transmitted as a brief coded message. Information about the version of the stored data or data groups in the memory allocated to the mobile transceiver, and/or the manufacturer of the stored data or data groups and/or the issue date of the stored data or data groups is transmitted to the base station in the traffic-information query, so that in the return message of the traffic information, the base station can undertake the coding in such a way that the coded data can be well utilized on the basis of the stored data in the vehicle. In this manner, even given changing data, it is ensured in all events that the mobile transceiver is able to interpret the coded traffic messages.

13 Claims, 2 Drawing Sheets

METHOD FOR REQUESTING AND PROCESSING TRAFFIC INFORMATION

BACKGROUND INFORMATION

A method and arrangement for the information of mobile subscribers are described in PCT International Patent Publication No. WO 98/26396. In that case, data is transmitted in response to inquiry and/or automatically between a central unit and a mobile subscriber unit. This data is intended to be used in particular to transmit traffic information to the mobile subscriber. In principle, this can be done in two ways. On the one hand, all information concerning traffic routing is given to the mobile subscriber from the center (central unit), so that the road-user is completely dependent on the information from the center. The other possibility is for the road-user to carry a navigational unit with him in his vehicle, by which it is possible to obtain a traffic route from the given position at the moment to a destination position. In this case, the center is only used to have such traffic information transmitted which could lead to an obstruction of the journey, in particular traffic jams, roadblocks, detours or weather-contingent disturbances. This information can either be transmitted in plain text, or else in a reduced form, only codes being transmitted and these codes than being combined in the receiver to form complete messages. Such a measure is described, for example, in German Patent No. 35 36 820. A transceiver which permits both the transmission and the reception of messages must be provided for each subscriber in order to dispatch and receive information. For example, such a transceiver can be a customary mobile transceiver, but there can also be transmitters which transmit information on a specific frequency to a center, and radio receivers, for example, which are able to receive individualized messages. In this case, after processing the query, the center can then broadcast the information via a broadcast transmitter and, on the basis of the individual identifier, can assure that only the receiver which is individualized correspondingly is able to interpret the message.

SUMMARY OF THE INVENTION

According to the present invention, on the basis of the information transmitted to the center, it is ensured that the coded traffic messages can at all events also be interpreted in the vehicle, since the transmitted version identifier ensures that the information transmitted back from the center can also be interpreted in the vehicle with the data existing there. Misinformation or false information which relates to false or missing versions of the stored data is thereby reliably avoided.

It is advantageous that a plurality of data groups for different geographical regions are stored in the memory. This measure makes it possible for the vehicle having the device to interpret and process coded transmitted traffic messages in a larger geographical region, i.e., in France, Great Britain, and in the Benelux countries as well, in addition to Germany. Another advantage is that a plurality of data groups having different details are stored in memory for a geographical region. This measure ensures that, for example, further and more detailed information is made available for specific regions such as large cities or regions of interest to tourists. In response to a request for traffic information, this detailed information at hand can be taken into account in a response from the base station.

It is also beneficial that the version and/or the manufacturer and/or the issue date, also denoted as data-group information, are transmitted in the traffic query, separately for each data group. These measures ensure that, for example, even when the stored data is expanded by complementary purchase, such as regionally, evaluable traffic information is always made available, regardless of how old the stored data is with respect to the different regions.

Furthermore, it is advantageous, along with the traffic-information query, to transmit information as to whether the radio receiver having the navigational device is able or not to evaluate several data groups simultaneously. Particularly in the case of simple devices, there is the problem that traffic messages can only be evaluated utilizing one data group. It is therefore not sensible if, during a transmission, traffic information is transmitted from the base station which requires several data groups for the evaluation, since then an evaluation in a predefined reaction time is no longer possible. In this case, only such information is sent back from the base station which is evaluable using one data group.

It is also advantageous that the traffic-information query is sent in response to prompting. Because of this, it is up to the user as to how frequently he would like to request traffic messages. Particularly when, after a query, he determines that traffic obstructions are not to be anticipated, often new queries are first really necessary after a longer driving time. Therefore, the user of the device is able to transmit queries according to his wishes.

It is also expedient to request the traffic information at predefined time intervals. The driver of a vehicle is relieved by this measure. He does not always have to think whether a new traffic message is necessary. Rather, an inquiry about traffic obstacles is made as a function of the route being traveled on, or according to time-related defaults, so that the driver is constantly informed about up-to-date traffic events, particularly about new obstacles on the roads, without he himself having to think about it.

It is also advantageous to calculate a route from a present point to a destination point based on the received traffic information. In so doing, the information about the traffic jams and obstructions, transmitted based on the traffic query, is taken into account when determining the route. It is also advantageous not to transmit all the traffic information corresponding to the query criteria, but rather only such traffic information lying in (pertaining to traffic conditions in) a predefined corridor between the present point and the destination point. In this manner, the number of traffic messages is further restricted, it being necessary to take heed that the corridor is selected in such a way that possible and useful bypass roads are also determined.

It is likewise beneficial that, given the evaluation possibility of a plurality of data groups in the transceiver or the navigation device, the location code is transmitted together with the version from the base station. In this manner, even in the case of expanded geographical regions such as Germany and France, the location is clearly allocated, so that French locations are allocated to the French data group and German locations are allocated to the German data group.

DETAILED DESCRIPTION

Figure 1:
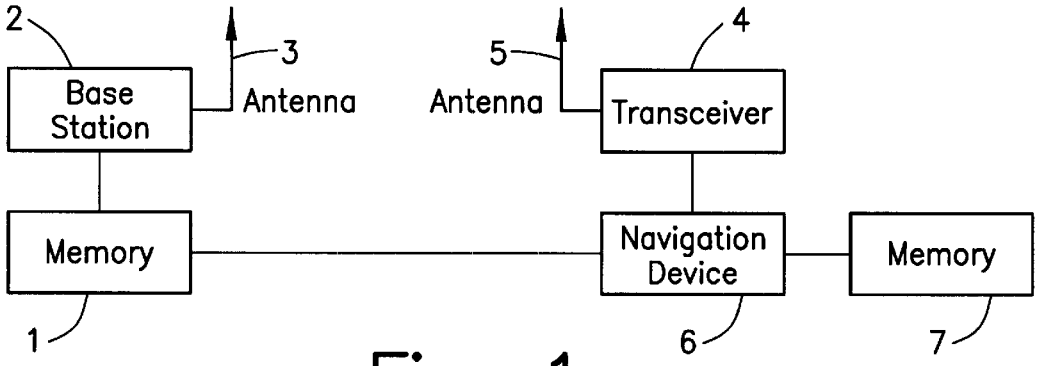
FIG. 1 shows a vehicle mobile transceiver (radio set) and a central radio transmitter-receiver installation.

FIG. 1 shows a mobile transceiver 4, installed in a vehicle not shown, which is able to broadcast and receive radio transmissions via an antenna 5. To be understood by mobile transceivers are, for example, transceivers which operate according to the GSM or AMPS standard, but also individualized broadcast receivers such as DAB (digital audio broadcasting) receivers which have a backward (reverse) channel, or where the transmitted signal is broadcast on a different mobile radiofrequency channel. Mobile transceiver 4 is connected to a navigation device 6 having the ability to determine a route which a vehicle is to travel based on the present location of the vehicle and an input destination location.

To that end, navigation device 6 is connected to a mass memory 7. Mass memory 7 contains information in digital form about roads of a specific geographical region. The memory also contains information in data groups for the interpretation of traffic messages transmitted in coded form, these traffic messages being received in coded form in radio receiver 4. Details about this are described in German Patent No. 35 36 820. Also stored in memory 7 in the data groups is information about the location codes of the traffic messages transmitted in coded form, as well as their connection to the location codes of the digital map. FIG. 1 also shows a base station 2 which, via an antenna 3, is able to receive radio signals from mobile transceiver 4 and to transmit messages back to mobile transceiver 4. In addition to a mobile radio communications base station of a mobile radio communications network, the base station can also be a broadcast transmitter such as a DAB transmitter, which is able to transmit individualized messages, having a backward channel receiver or a mobile radio receiver. Base station 2 is connected to a memory 1 where information about traffic disruptions and obstacles is input, coded and made available for broadcast.

If the driver of a vehicle is now beginning a journey and has input a destination point into his navigation system, then a connection is established with base station 2 by the user of mobile device 4, either manually when the driver has tuned it in such as by pushing a button, or automatically.

Figure 2:
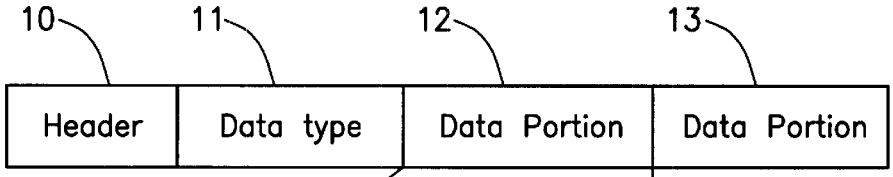
FIG. 2 shows the structure of the data word which is transmitted from the mobile subscriber to the center (central unit).

At this point, a radiogram according to FIG. 2 is transmitted to base station 2. The radiogram according to FIG. 2 has a header 10, by which the base station is able to recognize who is requesting what type of information. In addition, the message according to FIG. 2 has a field for the data type 11. Data type 11 indicates how data portion 12 and 13 of the radiogram from the mobile station to the base station is composed. Based on this information, the base station is now able on the one hand to identify the forwarding station, and on the other hand to recognize the query profile. The transmitted radiogram is evaluated according to data type 11 by the appropriate service provider in the base station.

Figure 3:
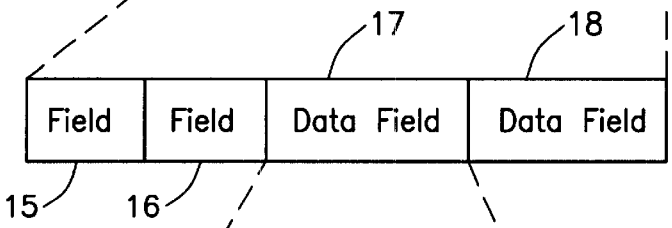
FIG. 3 shows a portion of the structure of FIG. 2.

Data portion 12 is shown in detail in FIG. 3. In the exemplary embodiment, data portion 12 includes a field 15 in which is indicated how many data groups are stored in memory 7. Field 16 indicates whether one or more data groups are allowed in the return transmission of the traffic information for evaluation. If it is merely a question of simple receivers which are not able to assure the evaluation of traffic information on the basis of a plurality of data groups, it is transmitted in data field 16 that only one data group may be used for producing the traffic messages. It also follows that only one data group can be used if only a single data group, such as the location codes as well as the road links of Germany, is stored in memory 7. Data fields 17 and 18 contain data-group information items. If only one data group is stored in memory 7, and based on data field 15, only one data group is allowed, then only one data-group information item is transmitted in data field 17, as well. If two data-group information items are allowed, then two data-group information items are transmitted; if a plurality of data groups are allowed, then data fields 17 and 18 can be supplemented by further data fields. Data field 15 must be consistent with the number of data-group information items in data fields 17, 18 and subsequent. If, given a transmission from mobile transceivers, the traffic message can only be evaluated using one data group, this is indicated in field 16.

In FIG. 2, the data word is supplemented by a further data field 13, by which further information can be transmitted. The further information which can be additionally transmitted is, for example, information about the intended use of roads subject to a toll, and/or the type of vehicle, as well as information about the present location of the vehicle and the desired destination.

Figure 4:
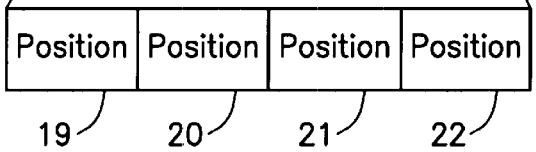
FIG. 4 shows a portion of the structure of FIG. 3.

FIG. 4 shows in detail the contents of data fields 17 or 18. At position 19, the version number of the data group stored in memory 7 is transmitted. Stored at position 20 is the issue date on which this data group was published. The manufacturer of the data group is recorded at position 21, in order to be able to differentiate different manufacturers with specific differences in the case of one and the same data group. The version number of the manufacturer is indicated at position 22. This information ensures that the devices in the vehicle are in the position to be able to reliably decode the traffic messages on the mobile-transceiver side. While it can usually be assumed that a service provider will recognize the data groups in different versions and from different manufacturers, different data groups which differ with respect to their content and their age will be in the vehicle devices, usually depending upon the age of the vehicle, the manufacturer of the navigation device, or even the vehicle manufacturer. Since roads are constantly being added and other roads are eliminated, and designations of location names are also frequently changed, when an older version of a data group is stored in the vehicle, an evaluation of the information from the service provider is no longer possible if traffic information has been created by the base station on the basis of a newer version of the table of data groups. By transmitting the version numbers, the manufacturer of the respective version and the creation dates, it is possible to ensure that the service provider will transmit only such data which can be evaluated by the vehicle device.

On the other hand, such data is not transmitted for which either there are no data groups in the vehicle device, or where its evaluation is hindered. Namely, if a vehicle is in the border region between Germany and France, for example, and the driver intends to drive to France, it is not useful to transmit information about French traffic obstructions if the data tables in the vehicle receiver are not capable of evaluating traffic information in the French region. On the other hand, it is also not useful to transmit data when, because of its simple type of construction, the vehicle receiver is only able to evaluate information of a single data group within the framework of a data telegram. In this case, even if the vehicle receiver contains both the French and the German data tables, it is not advisable to transmit German and French traffic information in a mixed form. This is possibly prevented by the information in data field 16.

Figure 5:
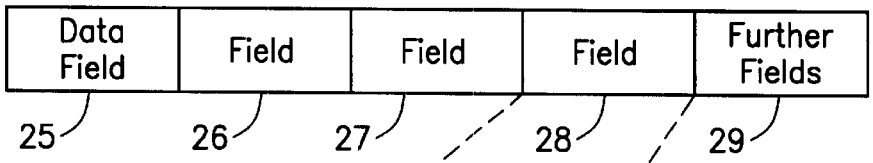
FIG. 5 shows the structure of the data word which is transmitted back from the center to the mobile subscriber.

In FIG. 5, the data word is represented which is emitted via base station 2 from the service provider, after the service provider has received and evaluated the data word according to FIG. 2. Data field 25 contains the header which, for example, includes as information the destination address, i.e., the mobile radio communications station for which the message is intended. Field 26 indicates the number of transmitted messages, so that the mobile transceiver can recognize when the message is complete. Field 27 specifies which data group in memory 7 of radio receiver 4 must be accessed in order to be able to evaluate the subsequent information. This information corresponds to the information which was sent by mobile transceiver 4 in field 19 to the base station. This field is particularly important when, in the transmission of a message, the radio receiver is only able to interpret one data group, or else only one data group is stored in memory 7. At this point, traffic messages are transmitted in field 28, which can be followed by further fields 29 if more than one traffic message is to be transmitted.

Figure 6:
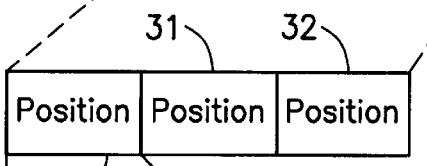
FIG. 6 shows a portion of the structure of FIG. 5.

FIG. 6 shows in detail how field 28 or further fields 29 are specifically composed. Transmitted at position 30 is the location code of a traffic message, for instance, at what location of an expressway one can expect a traffic jam. Position 31 indicates the extent of the traffic disturbance. For example, it is noted here whether a possibly existing traffic jam or the blocking of a road extends over one or more exits or over a specific number of kilometers. At position 32 it is specified in which direction the traffic obstruction is located, for example, whether it is a traffic obstruction in the south or west driving direction, or a traffic obstruction in the north or east driving direction. With the information thus available, it is now possible for a navigation system to calculate a route in such a way that the time expenditure for the vehicle driver is very low. Namely, if the obstructions as such and the length of the obstructions, as well as their direction, are known, then based on the map material which can also be taken from memory 7, the navigation system can check whether possibly a different route which is longer than the previously calculated route would or would not lead more quickly to the destination.

Figure 7:
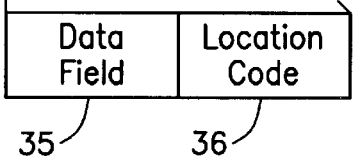
FIG. 7 shows a portion of the structure of FIG. 6.

FIG. 7 shows clearly that location code 30 is in turn divided into two pieces of information, first the data field 35 in which the version number of field 19 is written, as well as into the actual location code 36. Due to this measure, if the receiver is able to interpret the location code from different data groups in one data telegram, an instruction is received as to which data group a specific location code belongs. For example, if one imagines that the data group for Germany has the same location code for Saarbrucken as Nizza for the French data group, then it is very important that the data group also be indicated for the location code. However, the result is that the location code must be transmitted, not with a very small bit width such as with 8 or 16 bits, but with a higher bit width such as with 32 bits. Field 27 is then an empty field into which a zero is input, for example. However, at this point it is possible that not all receivers are able to interpret these complex location codes. Therefore, they are dependent solely on the data-group information in field 27, where the data group for all subsequent traffic information is determined, whereas no determination is carried out when the data group is linked later to the location code. It may be that, in the first case, the location code of data field 30 can be shortened to 8 or 16 bits, but it is not possible to relay data-group information items. For this reason, in the case of simple receivers, the output of traffic information is therefore restricted to one data group, which s determined in field 27—either to Germany or to France in the example mentioned.

Figure 8:
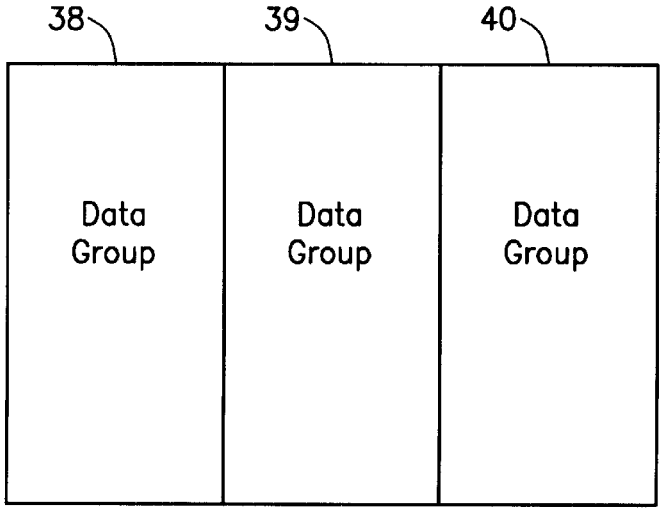
FIG. 8 shows a possible distribution of data groups.

FIG. 8 now shows the set-up of data groups, which is stored in memory 7 allocated to mobile transceiver 4. Data group 38 is a table in which location codes, road links and standard texts of Germany are stored, as, for example, is described in more detail in German Patent No. 35 36 820 or in the Standard ENV-278/7/3/006. Data group 39 relates to location information and road links to be found in France, and data group 40 relates to tables in which location codes and road links of the city Frankfurt am Main are specified more precisely. The list of the data groups can be arbitrarily constructed. Thus, data groups having tourist sites such as of the Black Forest or of the Allgau are also possible.

Based on the transmitted traffic information, navigation system 6 is able to calculate a route from the present point to the destination point, taking into account the requested traffic information, it being possible to bypass traffic obstructions in so far as this is necessary. Furthermore, if the present point and the destination point are known, it is useful to transmit only such traffic messages which pertain to traffic conditions in a corridor between the present point and the destination point. Thus, it is not necessary to transmit all traffic information of Germany or France, but rather the traffic information can be restricted to a specific region in the direction of the travel route.

What is claimed is:

1. A method for requesting and for processing traffic information, comprising the steps of:

transmitting a traffic-information query by a transceiver, the query including information about at least one of: (a) a version of at least one group of data which can be arbitrarily constructed into a list stored in a memory allocated to the transceiver, (b) a manufacturer of the stored data, and (c) an issue date of the stored data; and providing at least one traffic message by a service provider via a base station and transmitting the at least one traffic message to the transceiver, the at least one traffic message being transmitted as at least one return short message, the at least one traffic message being evaluable on the basis of the at least one group of data stored in the memory.

2. The method according to claim 1, wherein the query is transmitted automatically at predefined time intervals.

3. The method according to claim 1, further comprising the step of calculating a route from a present point to a destination point, taking into consideration requested traffic information.

4. The method according to claim 3, further comprising the step of transmitting the present point and the destination point with the query, wherein only traffic messages pertaining to traffic conditions in a corridor between the present point and the destination point are transmitted.

5. A method for requesting and for processing traffic information, comprising the steps of:

transmitting a traffic-information query by a transceiver, the query including information about at least one of: (a) a version of at least one group of data stored in a memory allocated to the transceiver, (b) a manufacturer of the stored data, and (c) an issue date of the stored data; and providing at least one traffic message by a service provider via a base station and transmitting the at least one traffic message to the transceiver, the at least one traffic message being transmitted as a TMC message via radio, the at least one traffic message being evaluable on the basis of the at least one group of data stored in the memory.

6. A method for requesting and for processing traffic information, comprising the steps of:

transmitting a traffic-information query by a transceiver, the query including information about at least one of: (a) a version of at least one group of data, which includes a plurality of data groups for different geographical data, stored in a memory allocated to the transceiver, (b) a manufacturer of the stored data, and (c) an issue date of the stored data; and providing at least one traffic message by a service provider via a base station and transmitting the at least one traffic message to the transceiver, the at least one traffic message being transmitted as at least one return short message, the at least one traffic message being evaluable on the basis of the at least one group of data stored in the memory.

7. A method for requesting and for processing traffic information, comprising the steps of:

transmitting a traffic-information query by a transceiver, the query including information about at least one of: (a) a version of at least one group of data, which includes a plurality of data groups of different particularization stored in the memory for a geographical region, stored in a memory allocated to the transceiver, (b) a manufacturer of the stored data, and (c) an issue date of the stored data; and providing at least one traffic message by a service provider via a base station and transmitting the at least one traffic message to the transceiver, the at least one traffic message being transmitted as at least one return short message, the at least one traffic message being evaluable on the basis of the at least one group of data stored in the memory.

8. A method for requesting and for processing traffic information, comprising the steps of:

transmitting a traffic-information query by a transceiver, the query including information about at least one of: (a) a version of at least one group of data stored in a memory allocated to the transceiver, (b) a manufacturer of the stored data, and (c) an issue date of the stored data; and providing at least one traffic message by a service provider via a base station and transmitting the at least one traffic message to the transceiver, the at least one traffic message being transmitted as at least one return short message, the at least one traffic message being evaluable on the basis of the at least one group of data stored in the memory;

wherein the at least one of the version, the manufacturer and the issue date is transmitted in the query separately for each of the at least one data group.

9. A method for requesting and for processing traffic information, comprising the steps of:

transmitting a traffic-information query by a transceiver, the query including information about at least one of: (a) a version of at least one group of data stored in a memory allocated to the transceiver, (b) a manufacturer of the stored data, and (c) an issue date of the stored data; and providing at least one traffic message by a service provider via a base station and transmitting the at least one traffic message to the transceiver, the at least one traffic message being transmitted as at least one return short message, the at least one traffic message being evaluable on the basis of the at least one group of data stored in the memory;

wherein the query includes an item of information as to whether a radio receiver having a navigation device evaluates traffic messages only on the basis of one data group, and wherein, in accordance with the item of information, only traffic messages are transmitted which are evaluable with one data group.

10. A method for requesting and for processing traffic information, comprising the steps of:

transmitting a traffic-information query by a transceiver in response to prompting, the query including information about at least one of: (a) a version of at least one group of data stored in a memory allocated to the transceiver, (b) a manufacturer of the stored data, and (c) an issue date of the stored data; and providing at least one traffic message by a service provider via a base station and transmitting the at least one traffic message to the transceiver, the at least one traffic message being transmitted as at least one return short message, the at least one traffic message being evaluable on the basis of the at least one group of data stored in the memory.

11. A method for requesting and for processing traffic information, comprising the steps of:

transmitting a traffic-information query by a transceiver, the query including information about at least one of: (a) a version of at least one group of data stored in a memory allocated to the transceiver, (b) a manufacturer of the stored data, and (c) an issue date of the stored data;

providing at least one traffic message by a service provider via a base station and transmitting the at least one traffic message to the transceiver, the at least one traffic message being transmitted as at least one return short message, the at least one traffic message being evaluable on the basis of the at least one group of data stored in the memory; and transmitting a location code together with the version of at least one group of data stored in the memory, given an evaluation possibility of a plurality of data groups in one of the transceiver and a navigation device.

12. A method for requesting and for processing traffic information, comprising the steps of:

transmitting a traffic-information query by a transceiver, the query including information about at least one of: (a) a version of at least one group of data stored in a memory allocated to the transceiver, the version of at least one group of data stored in the memory being transmitted singularly by the base station when the transceiver has signaled that an evaluation of traffic information is based on one data group, (b) a manufacturer of the stored data, and (c) an issue date of the stored data; and providing at least one traffic message by a service provider via a base station and transmitting the at least one traffic message to the transceiver, the at least one traffic message being transmitted as at least one return short message, the at least one traffic message being evaluable on the basis of the at least one group of data stored in the memory.

13. A method for requesting and for processing traffic information, comprising the steps of:

transmitting a traffic-information query by a transceiver, the query including information about at least one of: (a) a version of at least one group of data stored in a memory allocated to the transceiver, the version of at least one group of data stored in the memory being transmitted with a location code of a respective traffic message when the transceiver has signaled that an evaluation of traffic information can be based on a plurality of data groups, (b) a manufacturer of the stored data, and (c) an issue date of the stored data; and providing at least one traffic message by a service provider via a base station and transmitting the at least one traffic message to the transceiver, the at least one traffic message being transmitted as at least one return short message, the at least one traffic message being evaluable on the basis of the at least one group of data stored in the memory.

* * * * *